US011781343B2

(12) United States Patent
Lee

(10) Patent No.: US 11,781,343 B2
(45) Date of Patent: Oct. 10, 2023

(54) DUST-PROOF AND ANTI-THEFT TUBULAR LOCK ASSEMBLY

(71) Applicant: ABA LOCKS INTERNATIONAL CO., LTD., New Taipei (TW)

(72) Inventor: Miko Lee, New Taipei (TW)

(73) Assignee: ABA LOCKS INTERNATIONAL CO., LTD., New Taipei (TW)

( * ) Notice: Subject to any disclaimer, the term of this patent is extended or adjusted under 35 U.S.C. 154(b) by 323 days.

(21) Appl. No.: 17/244,223

(22) Filed: Apr. 29, 2021

(65) Prior Publication Data

US 2022/0349211 A1 Nov. 3, 2022

(51) Int. Cl.

| | |
|---|---|
| ***E05B 17/18*** | (2006.01) |
| ***E05B 27/08*** | (2006.01) |
| ***E05B 19/00*** | (2006.01) |
| ***E05B 35/00*** | (2006.01) |
| ***E05B 15/02*** | (2006.01) |
| ***E05B 35/12*** | (2006.01) |
| ***E05B 17/14*** | (2006.01) |

(52) U.S. Cl.

CPC ..... *E05B 17/18* (2013.01); *E05B 15/029* (2013.01); *E05B 17/14* (2013.01); *E05B 17/142* (2013.01); *E05B 19/0047* (2013.01); *E05B 27/083* (2013.01); *E05B 35/008* (2013.01); *E05B 35/12* (2013.01)

(58) Field of Classification Search

CPC ..... E05B 15/029; E05B 17/14; E05B 17/142; E05B 17/18; E05B 17/185; E05B 17/186; E05B 19/0047; E05B 27/08; E05B 27/083; E05B 35/12; E05B 35/008

See application file for complete search history.

(56) References Cited

U.S. PATENT DOCUMENTS

| | | | | |
|---|---|---|---|---|
| 1,061,866 A * | 5/1913 | Petersen | E05B 17/14 | 70/423 |
| 1,846,078 A * | 2/1932 | Behrendt | E05B 17/14 | 70/424 |
| 2,213,814 A * | 9/1940 | Jacobi | E05B 17/185 | 70/455 |
| 4,073,165 A * | 2/1978 | Grundstrom | E05B 17/185 | 70/389 |
| 5,195,342 A * | 3/1993 | Werner | E05B 17/14 | 70/423 |

(Continued)

FOREIGN PATENT DOCUMENTS

| | | | |
|---|---|---|---|
| WO | WO-0242588 A1 * | 5/2002 | E05B 17/14 |

*Primary Examiner* — Christopher J Boswell

(74) *Attorney, Agent, or Firm* — RABIN & BERDO, P.C.

(57) ABSTRACT

A tubular lock assembly has a tubular lock, a cover, and a disassembling unit. The tubular lock has an annular keyhole and a cover screw hole enclosed by the keyhole. The cover is detachably assembled with the tubular lock, and has a covering board segment, a screw rod segment, and a first fitting segment. The covering board segment covers the keyhole. The screw rod segment is detachably screwed in the cover screw hole of the tubular lock. The first fitting segment is formed on the covering board segment. The disassembling unit has a second fitting segment. The second fitting segment corresponds in shape and size with the first fitting segment of the cover, such that the second fitting segment is adapted to engage with the first fitting segment, and the disassembling unit is capable of rotating the cover.

7 Claims, 11 Drawing Sheets

(56) References Cited

U.S. PATENT DOCUMENTS

| | | | | |
|---|---|---|---|---|
| 5,400,628 | A * | 3/1995 | Ryan | E05B 15/1614 70/423 |
| 7,621,161 | B2 * | 11/2009 | Fontana | E05B 17/142 70/276 |
| 11,136,786 | B2 * | 10/2021 | Colligan | E05B 17/142 |
| 2019/0338569 | A1 * | 11/2019 | Manly | E05B 17/142 |
| 2023/0044765 | A1 * | 2/2023 | Pedersen | E05B 17/147 |

* cited by examiner

DUST-PROOF AND ANTI-THEFT TUBULAR LOCK ASSEMBLY

BACKGROUND OF THE INVENTION

1. Field of the Invention

The present invention relates to a tubular lock assembly, especially to a tubular lock assembly that is dust-proof and is anti-theft, preventing technical cracking of the locking mechanism.

2. Description of the Prior Arts

A tubular lock has the advantages of simple structure, small size, low cost, and being difficult to unlock without the key by technically cracking its locking mechanism, so the tubular locks are suitable for and widely used in devices such as vending machines, parking meters, game machines, and coin lockers.

However, in a conventional tubular lock, the keyhole is uncovered and the pins inside the lock cylinder are exposed via the keyhole, which means that every pin can be seen directly through the keyhole from outside. As a result, the conventional tubular lock has the following disadvantages.

First, moisture and dust can easily enter the tubular lock, so the pins and springs behind each will get rusty and get stuck, making the tubular lock unable to be unlocked.

Second, the tubular lock is more difficult to be unlocked by technical cracking than traditional locks. However, the keyhole is not covered and the pins are exposed in the keyhole, which means if someone intentionally commits a lot of time and effort on trial and error, it is still possible to unlock the tubular lock without the key by technically cracking its locking mechanism.

To overcome the shortcomings, the present invention provides a tubular lock assembly to mitigate or obviate the aforementioned problems.

SUMMARY OF THE INVENTION

The main objective of the present invention is to provide a tubular lock assembly that has a cover to cover the keyhole, such that the cover prevents the dust from entering the tubular lock to ensure the tubular lock will not be stuck, and eliminate the chance of technical cracking attempts to unlock without the key.

The tubular lock assembly has a tubular lock, a cover, and a disassembling unit. The tubular lock has an inserting surface, a keyhole, and a cover screw hole. The keyhole is formed on the inserting surface and is annular. The cover screw hole is formed on the inserting surface and is enclosed by the keyhole. The cover is detachably assembled with the tubular lock, and has a covering board segment and a screw rod segment. The covering board segment covers the keyhole and has an inner surface and an outer surface. The inner surface faces to the tubular lock. The screw rod segment is formed on the inner surface of the covering board segment, and is detachably screwed in the cover screw hole of the tubular lock. The first fitting segment is formed on the outer surface of the covering board segment. The disassembling unit has a second fitting segment. The second fitting segment corresponds in shape and size with the first fitting segment of the cover, such that the second fitting segment is adapted to engage with the first fitting segment, and the disassembling unit is capable of rotating the cover relative to the tubular lock via the second fitting segment and the first fitting segment.

By forming the cover screw hole on the tubular lock, the cover can be assembled with the cover screw hole via the screw rod segment screwed in the cover screw hole, such that the covering board segment covers the keyhole to prevent dust from entering the keyhole, and prevent pins and springs behind each from getting rusty to ensure the tubular lock will not be stuck.

Besides, since the covering board segment covers and blocks the keyhole, even if someone attempts to commit a lot of time on technically cracking its locking mechanism to unlock without the key, such attempt can hardly be initiated because the keyhole is not accessible. As a result, the cover enhances the anti-theft performance of the tubular lock by eliminating the chance of technically cracking its locking mechanism to unlock.

In addition, the cover is first assembled with the disassembling unit via the second fitting segment and the first fitting segment engaging with each other, and then is rotated relative to the tubular lock by the disassembling unit to be disassembled. Therefore, as the first fitting segment and the second fitting segment are designed with unique specifications, which means making the first fitting segment and the second fitting segment into uniquely complementary shapes, the cover cannot be disassembled from the tubular lock without the disassembling unit, thereby further enhancing the anti-theft performance of the tubular lock.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
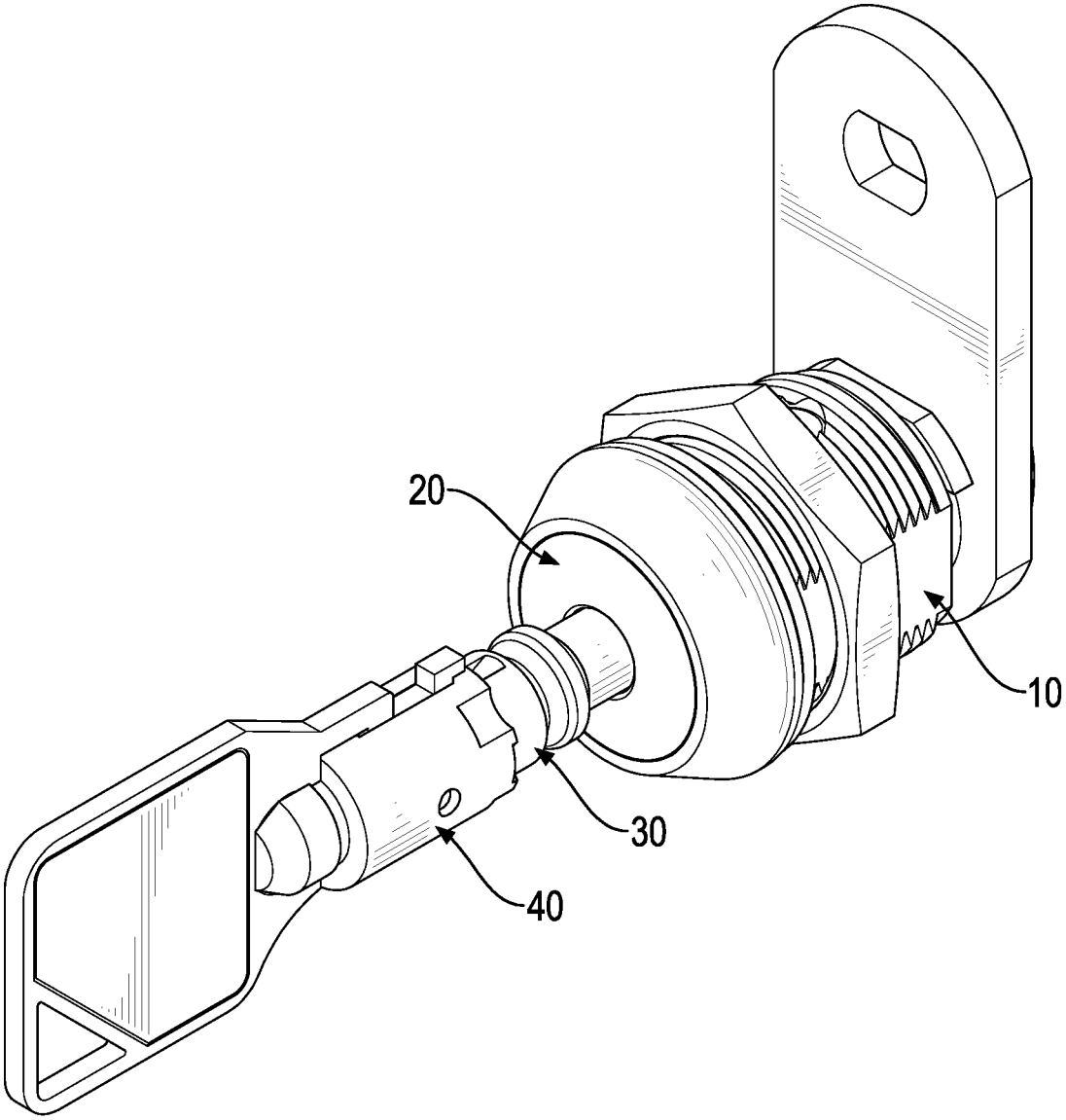
FIG. 1 is a perspective view of a first embodiment of a tubular lock assembly in accordance with the present invention.
Figure 2:
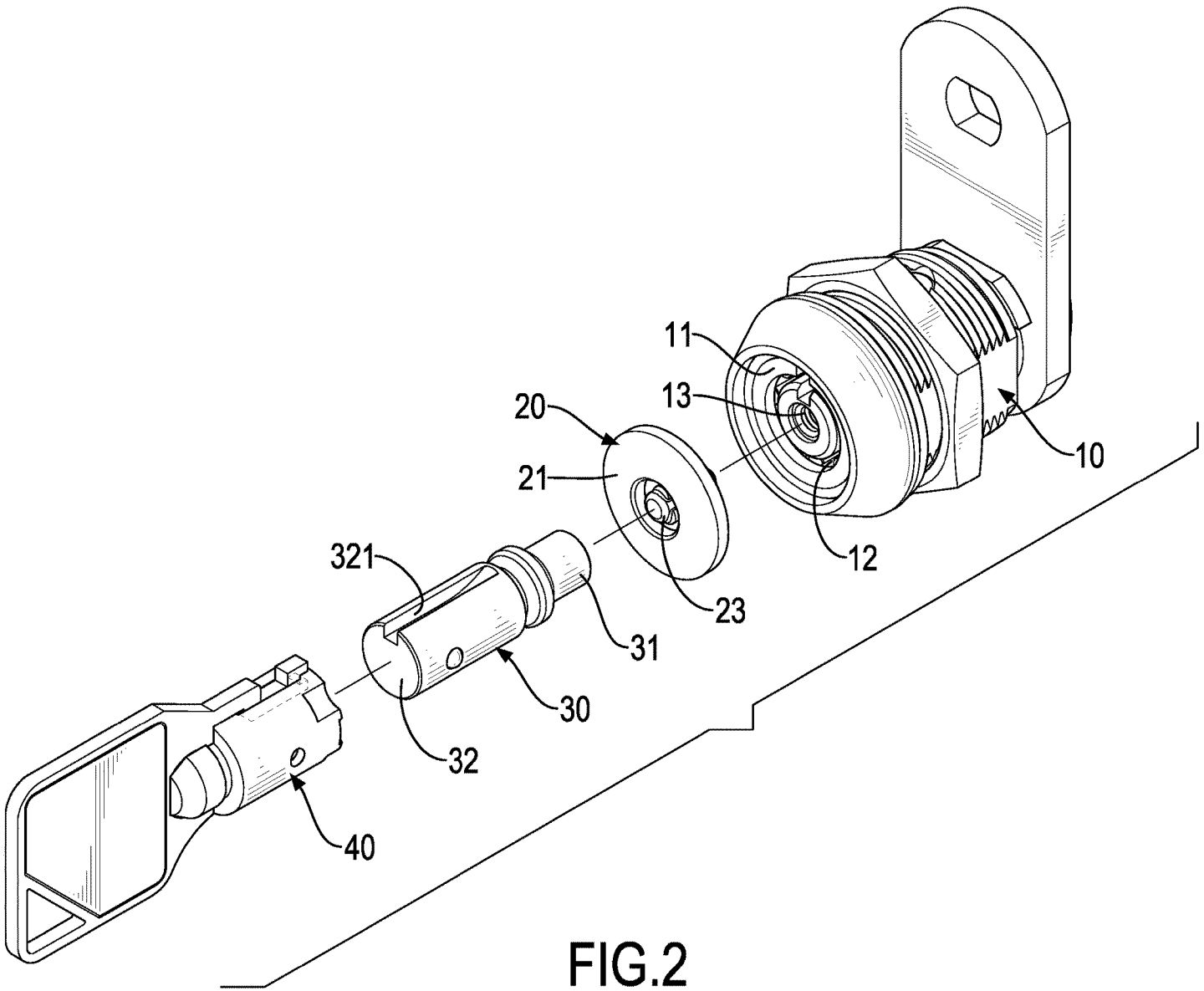
FIG. 2 is an exploded view of the first embodiment of the tubular lock assembly in FIG. 1.
Figure 3:
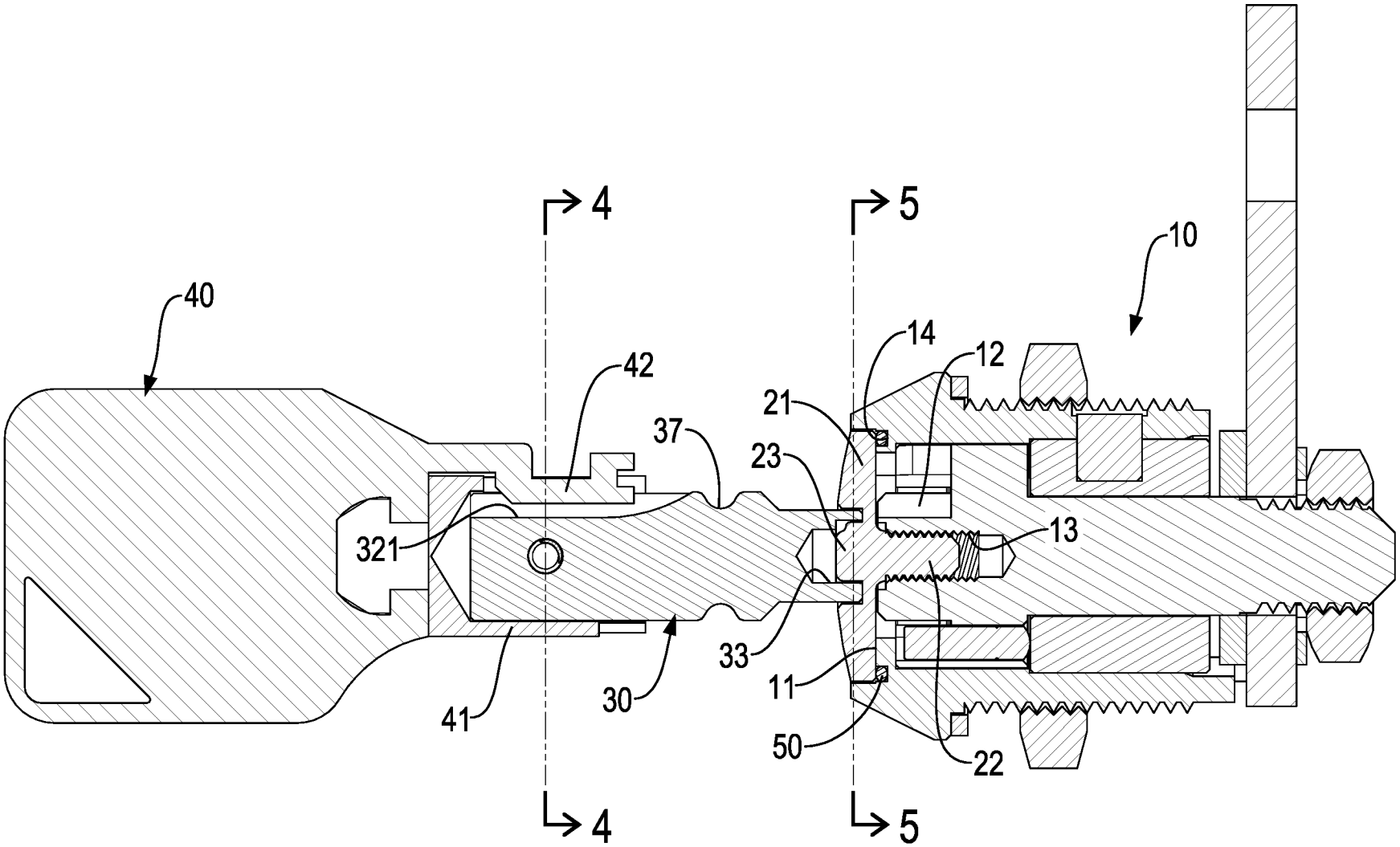
FIG. 3 is a side view in cross-section of the first embodiment of the tubular lock assembly in FIG. 1.
Figure 4:
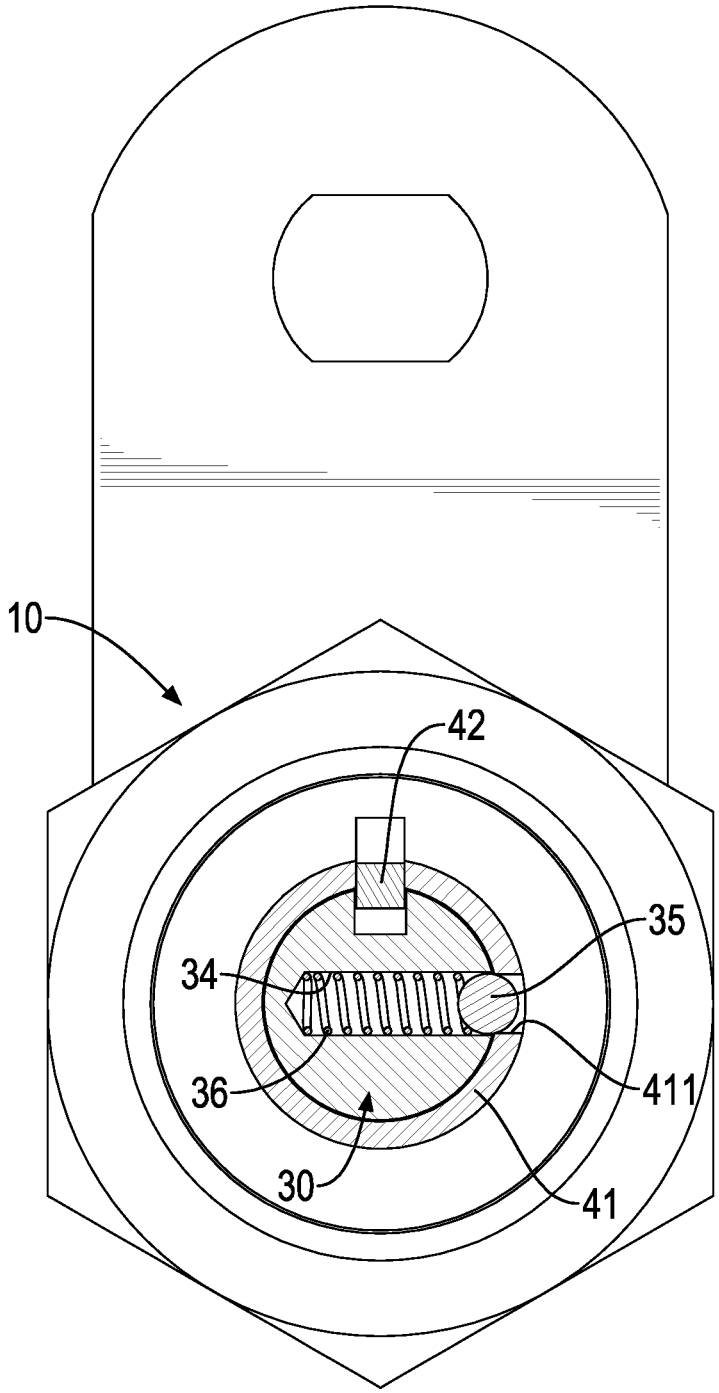
FIG. 4 is a front view in cross-section cut along the 4-4 line in FIG. 3.
Figure 5:
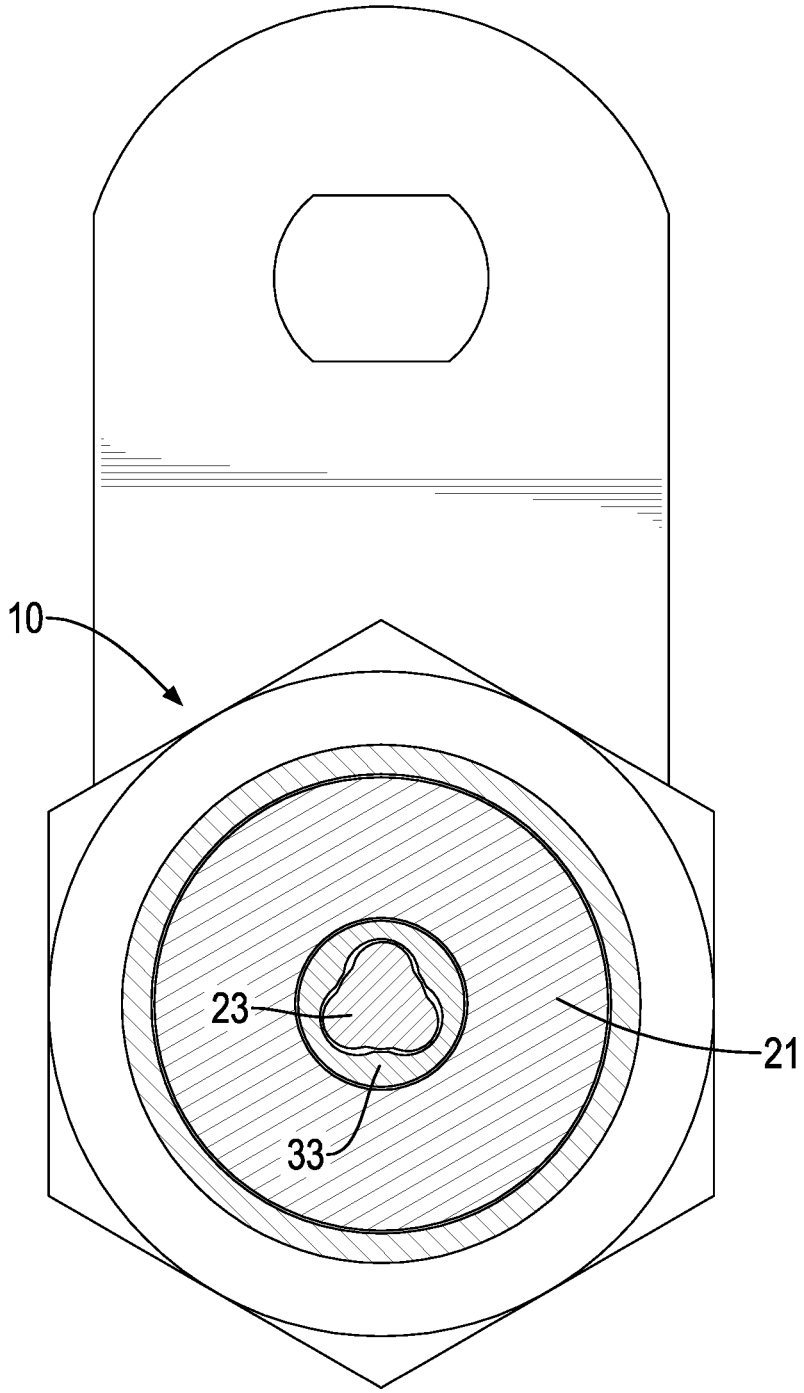
FIG. 5 is a front view in cross-section cut along the 5-5 line in FIG. 3.
Figure 6:
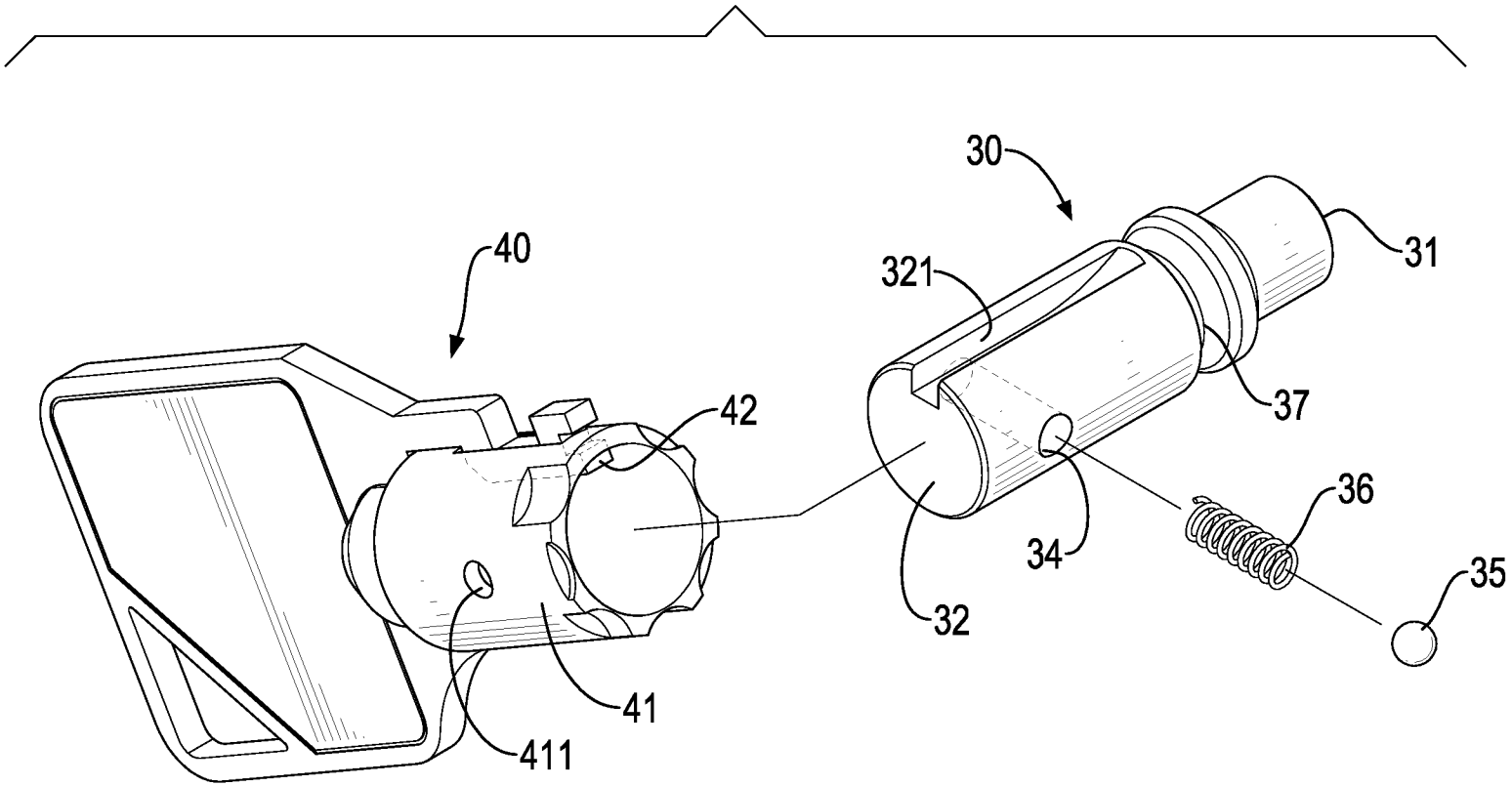
FIG. 6 is an exploded view of the first embodiment of the tubular lock assembly in FIG. 1, showing the key and the disassembling unit.
Figure 7:
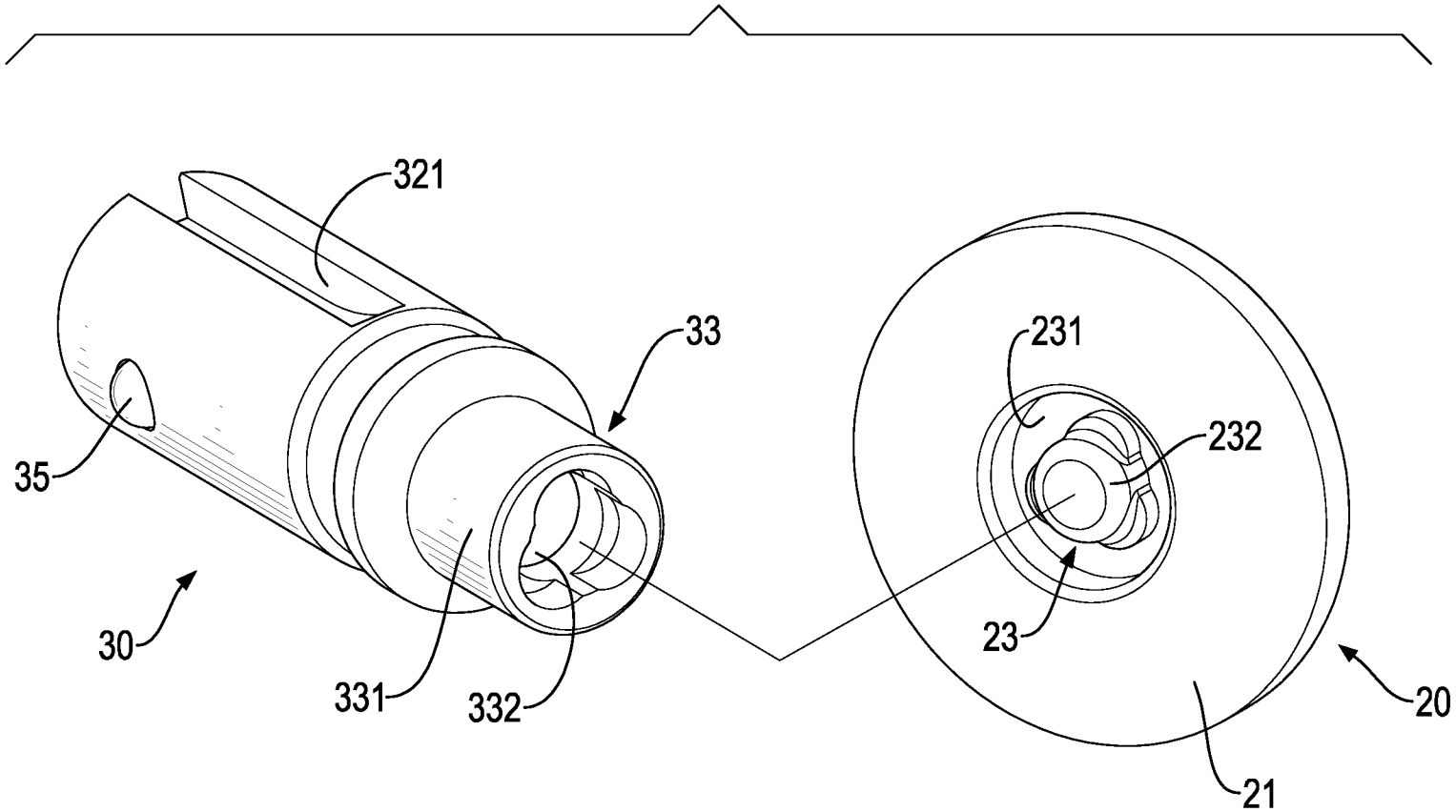
FIG. 7 is an exploded view of the first embodiment of the tubular lock assembly in FIG. 1, showing the disassembling unit and the cover.

With reference to FIGS. 1, 2, and 3, a tubular lock assembly in accordance with the present invention comprises a tubular lock 10, a cover 20, a disassembling unit 30, a key 40, and a rubber ring 50.

In a first embodiment, the tubular lock 10 has an inserting surface 11, a keyhole 12, a cover screw hole 13, and a sealing annular groove 14. The keyhole 12 is formed on the inserting surface 11 and is annular. The cover screw hole 13 is formed on the inserting surface 11 and is enclosed by the keyhole 12. The sealing annular groove 14 is formed on the inserting surface 11 and is located in an outer side of the keyhole 12.

With reference to FIGS. 3, 5, 7, and 8, the cover 20 is detachably assembled with the tubular lock 10, and has a covering board segment 21, a screw rod segment 22, and a first fitting segment 23. The covering board segment 21 covers the keyhole 12 and has an inner surface and an outer surface. The inner surface faces to the tubular lock 10. The screw rod segment 22 is formed on the inner surface of the covering board segment 21 and is detachably screwed in the cover screw hole 13 of the tubular lock 10. The first fitting segment 23 is formed on the outer surface of the covering board segment 21.

Specifically, in the first embodiment, the first fitting segment 23 has an cavity 231 and a fitting block 232. The cavity 231 is formed on the outer surface of the covering board segment 21 and is concaved toward the inner surface of the covering board segment 21. The fitting block 232 is formed in the cavity 231.

Moreover, the fitting block 232 is designed with unique specifications, which means a shape of the fitting block 232 is different to a conventional hexagon screw head or a star-shaped screw head, but is only complementary with a shape of the disassembling unit 30, thereby enhancing an anti-theft performance. Besides, in other embodiments, the first fitting segment 23 can also be implemented without the cavity 231, as the fitting block 232 can also be formed on the outer surface of the covering board segment 21.

With reference to FIGS. 3, 4, 6, and 7, in the first embodiment, the disassembling unit 30 is a round rod and has a first end 31, a second end 32, a second fitting segment 33, an assembling hole 34, a fixing unit 35, an elastic unit 36, and a holding recess 37.

The first end 31 is opposite to the second end 32. The second end 32 has a limiting groove 321 formed through an end surface of the second end 32. The second fitting segment 33 is formed on the first end 31. The second fitting segment 33 corresponds in shape and size with the first fitting segment 23 of the cover 20, such that the second fitting segment 33 is adapted to engage with the first fitting segment 23, and the disassembling unit 30 is capable of rotating the cover 20 relative to the tubular lock 10 via the second fitting segment 33 and the first fitting segment 23. The second fitting segment 33 has a cylinder 331 and a fitting cavity 332. An outer peripheral surface of the cylinder 331 corresponds in shape and size with the inner peripheral surface of the cavity 231 of the first fitting segment 23. The fitting cavity 332 is formed on an end surface of the cylinder 331, and the fitting cavity 332 corresponds in shape and size with the fitting block 232 of the first fitting segment 23. In other words, in the first embodiment, the first fitting segment 23 and the second fitting segment 33 are designed in unique specifications and are complementary in shape with each other, such that only the disassembling unit 30 can drive and rotate the cover 20 while any other tools cannot.

To sum up, a function of the first fitting segment 23 and the second fitting segment 33 is the same as that of a conventional set of lock and key, allowing unlocking only when both are complementary and matched. Additionally, the unique specifications of the first fitting segment 23 and the second fitting segment 33 can be implemented in infinite combinations, which means each set of the first fitting segment 23 and the second fitting segment 33 is different in shape from other sets, thereby ensuring only the specified disassembling unit 30 drives and disassembles the specific cover 20.

The assembling hole 34 is formed on an outer peripheral surface of the disassembling unit 30. The fixing unit 35 is movably mounted in the assembling hole 34. The elastic unit 36 is mounted in the assembling hole 34, pushes the fixing unit 35 toward outside of the assembling hole 34, and makes the fixing unit 35 protrude from the outer peripheral surface of the disassembling unit 30. The holding recess 37 is formed on the outer peripheral surface of the disassembling unit 30.

With reference to FIGS. 3, 4, 6, 9, and 10, the key 40 has an unlocking segment 41 and a limiting segment 42. The unlocking segment 41 is a round tube and is detachably mounted around the second end 32 of the disassembling unit 30. A fixing hole 411 is formed through the tube wall of the unlocking segment 41. An end surface of the unlocking segment 41 corresponds in shape and size with the keyhole 12 of the tubular lock 10, such that the key 40 is capable of unlocking the tubular lock 10. The limiting segment 42 is located in an inner side of the unlocking segment 41 and is detachably mounted in the limiting groove 321. The limiting groove 321 abuts the limiting segment 42 in a peripheral direction of the disassembling unit 30, such that the key 40 and the disassembling unit 30 are fixed in the peripheral direction of the disassembling unit 30.

The elastic unit 36 of the disassembling unit 30 pushes the fixing unit 35 against the fixing hole 411 of the unlocking segment 41, such that the key 40 and the disassembling unit 30 are fixed to each other. Besides, in other embodiments, the unlocking segment 41 can also be implemented as a cavity formed on an inner peripheral surface of the unlocking segment 41 instead of formed through the unlocking segment 41, which also works with the fixing unit 35 and achieves the same effect.

With the abovementioned structure, a user can insert the second end 32 of the disassembling unit 30 into the round-tubular unlocking segment 41 of the key 40, and the limiting segment 42 of the key 40 will enter the limiting groove 321 of the disassembling unit 30 from an opening formed by the limiting groove 321 on the end surface of the second end 32. Next, when the fixing unit 35, which protrudes from the outer peripheral surface of the disassembling unit 30, abuts an end of the unlocking segment 41 and the user further forcefully inserts the disassembling unit 30 into the unlocking segment 41, the fixing unit 35 compresses the elastic unit 36 and retracts into the assembling hole 34 such that the user is allowed to completely insert the disassembling unit 30 into the unlocking segment 41. During inserting, the fixing unit 35 keeps abutting the inner peripheral surface of the unlocking segment 41 due to the pushing of the elastic unit 36. The fixing unit 35 continuously contacts the fixing hole 411 of the unlocking segment 41, and the elastic unit 36 pushes the fixing unit 35 against the fixing hole 411, such that the key 40 and the disassembling unit 30 are fixed to each other.

Then, since the limiting groove 321 abuts the limiting segment 42 in a peripheral direction of the disassembling unit 30, the user can drive and rotate the disassembling unit 30 by the key 40 to unscrew and to disassemble the cover 20 from the tubular lock 10. Once the cover 20 is disassembled, the keyhole 12 is open.

Then, the user can pull off the disassembling unit 30 from the unlocking segment 41 of the key 40 by manually forcing at the holding recess 37 of the disassembling unit 30. During pulling, the fixing unit 35 retracts into the disassembling unit 30 again such that the user is allowed to detach the disassembling unit 30 from the key 40. At last, the unlocking segment 41 of the key 40 is allowed to enter the keyhole 12 of the tubular lock 10 to unlock the tubular lock 10.

But the abovementioned structure of the key 40 and the disassembling unit 30 is not limited thereto, as the key 40 can be implemented without the limiting segment 42, and the disassembling unit 30 can be implemented without the limiting groove 321, the assembling hole 34, the fixing unit 35, the elastic unit 36, and the holding recess 37. Further, the key 40 and the disassembling unit 30 can also be assembled by a plug or any other structure, and the disassembling unit 30 can even be used alone.

Figure 8:
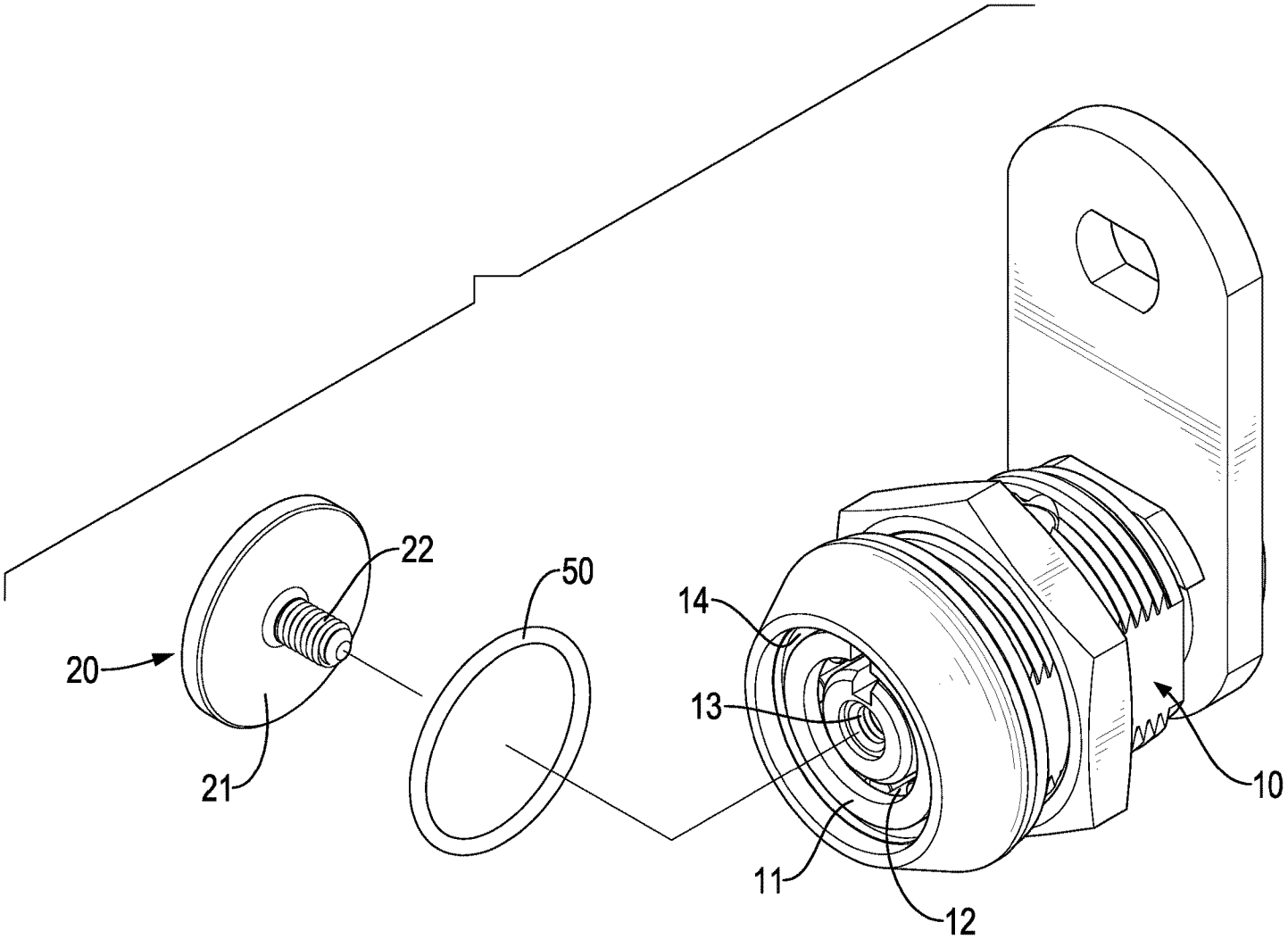
FIG. 8 is an exploded view of the first embodiment of the tubular lock assembly in FIG. 1, showing the cover and the tubular lock.
Figure 9:
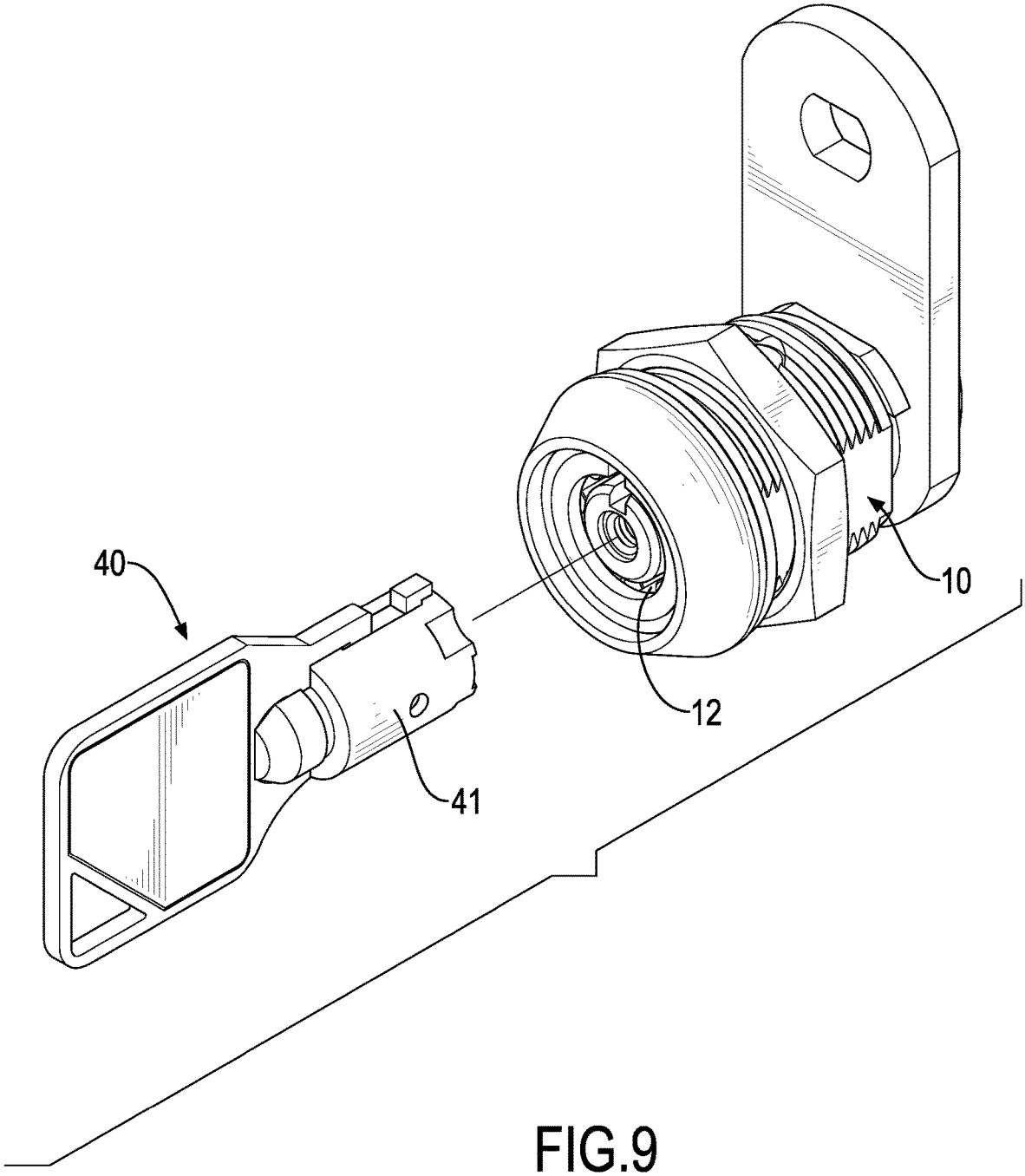
FIGS. 9 and 10 are operational views of the key and the tubular lock of the first embodiment of the tubular lock assembly in FIG. 1.
Figure 10:
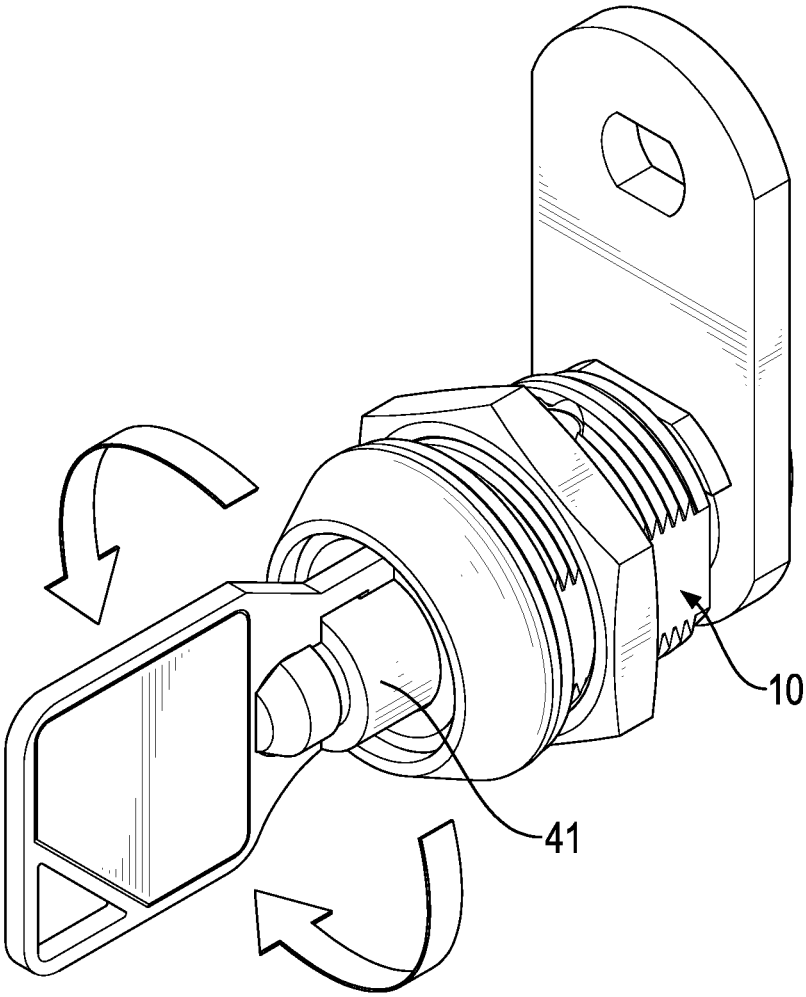

With reference to FIGS. 3 and 8, the rubber ring 50 is mounted in the sealing annular groove 14 and tightly fits against the inner surface of the covering board segment 21 of the cover 20. Thus, when the cover 20 is assembled with the tubular lock 10, the rubber ring 50 offers functions of sealing and waterproofness so as to prevent the internal components of the tubular lock 10 from rusting.

Figure 11:
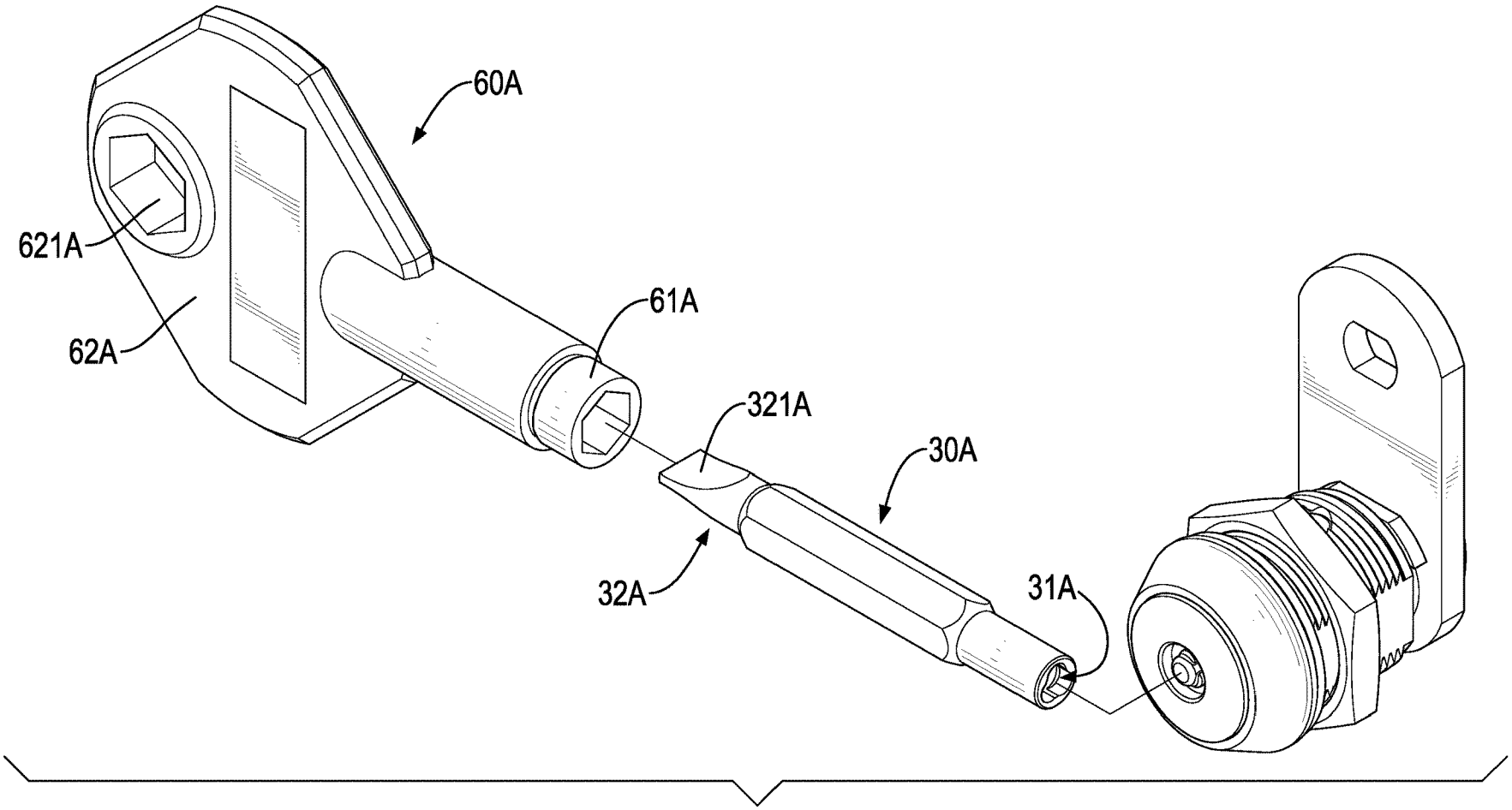
FIG. 11 is an exploded view of a second embodiment of a tubular lock assembly in accordance with the present invention.

With reference to FIG. 11, a structure of a second embodiment of the present invention is basically the same as the first embodiment, but the difference is that in the second embodiment, the disassembling unit 30A is a hexagonal rod, and the tubular lock assembly has a wrenching unit 60A. The wrenching unit 60A has a mounting tube segment 61A and a wrenching board segment 62A. An inner peripheral surface of the mounting tube segment 61A is hexagonal. The mounting tube segment 61A is detachably mounted around the disassembling unit 30A. The wrenching board segment 62A is connected to the mounting tube segment 61A, and extends beyond the mounting tube segment 61A in a radial direction of the mounting tube segment 61A. In other words, in the second embodiment, the disassembling unit 30A is used with the wrenching unit 60A. Therefore, the user can insert the second end 32A of the disassembling unit 30A into the mounting tube segment 61A, and hold the wrenching board segment 62A with fingers to turn the disassembling unit 30A to unscrew the cover 20A. Additionally, in the second embodiment, the wrenching board segment 62A of the wrenching unit 60A has a hexagonal hole 621A. The hexagonal hole 621A is adapted to be mounted around the disassembling unit 30A so the wrenching unit 60A can be assembled with the disassembling unit 30A via the hexagonal hole 621A, and then the mounting tube segment 61A becomes a handle for turning the wrenching unit 60A.

Furthermore, in the second embodiment, the second end 32A of the disassembling unit 30A forms a screwdriver head 321A, so the wrenching unit 60A and the disassembling unit 30A can be used together as a screw driver by inserting the first end 31A of the disassembling unit 30A into the mounting tube segment 61A.

By forming the cover screw hole 13 on the tubular lock 10, the cover 20 can be assembled with the cover screw hole 13 via the screw rod segment 22 screwed in the cover screw hole 13, such that the covering board segment 21 covers the keyhole 12 to prevent dust from entering the keyhole 12, and prevent pins and springs behind each from getting rusty, ensuring the tubular lock 10 will not be stuck.

Besides, since the covering board segment 21 covers and blocks the keyhole 12, even if someone attempts to commit a lot of time technically cracking the locking mechanism to unlock without the key 40, such attempt cannot be initiated because the keyhole 12 is unexposed and thus not accessible. As a result, the cover 20 enhances the anti-theft performance of the tubular lock 10 by eliminating the chance of technically cracking the locking mechanism.

In addition, the cover 20 is first assembled with the disassembling unit 30 via the second fitting segment 33 and the first fitting segment 23 engaging with each other, and then is rotated relative to the tubular lock 10 by the disassembling unit 30 to be disassembled. Therefore, by designing the first fitting segment 23 and the second fitting segment 33 with unique specifications, which means making the first fitting segment 23 and the second fitting segment 33 in uniquely complementary shapes, the cover 20 cannot be disassembled from the tubular lock 10 without the disassembling unit 30, thereby further enhancing the anti-theft performance of the tubular lock 10. Therefore, the disassembling unit 30 can be regarded as a second key, and the disassembling unit 30 and the key 40 can be kept in custody separately by two people, so the tubular lock 10 can be opened only when both of them agree.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tubular lock assembly comprising:

a tubular lock having an inserting surface;

a keyhole formed on the inserting surface and being annular; and a cover screw hole formed on the inserting surface and enclosed by the keyhole;

a cover detachably assembled with the tubular lock, and having a covering board segment covering the keyhole and having an inner surface and an outer surface; the inner surface facing to the tubular lock;

a screw rod segment formed on the inner surface of the covering board segment, and detachably screwed in the cover screw hole of the tubular lock; and a first fitting segment formed on the outer surface of the covering board segment;

a disassembling unit that is a round rod and has:

a first end with a second fitting segment formed thereon, the second fitting segment corresponding in shape and size with the first fitting segment of the cover, such that the second fitting segment is adapted to engage with the first fitting segment, and the disassembling unit is capable of rotating the cover relative to the tubular lock via the second fitting segment and the first fitting segment, and a second end opposite to the first end, and having a limiting groove formed through an end surface of the second end; and a key having an unlocking segment being a round tube and detachably mounted around the second end of the disassembling unit, an end surface of the unlocking segment corresponding in shape and size with the keyhole of the tubular lock, such that the key is capable of unlocking the tubular lock, and a limiting segment located in an inner side of the unlocking segment, and detachably mounted in the limiting groove, the limiting groove abutting the limiting segment in a peripheral direction of the disassembling unit, such that the key and the disassembling unit are fixed in the peripheral direction of the disassembling unit.

2. The tubular lock assembly as claimed in claim 1, wherein a fixing hole is formed on a tube wall of the unlocking segment of the key; and the disassembling unit has an assembling hole formed on an outer peripheral surface of the disassembling unit;

a fixing unit movably mounted in the assembling hole; and an elastic unit mounted in the assembling hole and pushing the fixing unit toward outside of the assembling hole, such that the fixing unit protrudes from the outer peripheral surface of the disassembling unit; the elastic unit pushing the fixing unit against the fixing hole of the unlocking segment such that the key and the disassembling unit are fixed to each other.

3. The tubular lock assembly as claimed in claim 2, wherein a holding recess is formed on the outer peripheral surface of the disassembling unit.

4. The tubular lock assembly as claimed in claim 3, wherein the first fitting segment of the cover has a cavity formed on the outer surface and concaved toward the inner surface;

a fitting block formed in the cavity; and the second fitting segment of the disassembling unit has a cylinder corresponding in shape and size with an inner peripheral surface of the cavity of the first fitting segment;

a fitting cavity formed on an end surface of the cylinder and corresponding in shape and size with the fitting block.

5. The tubular lock assembly as claimed in claim 4, wherein the tubular lock has a sealing annular groove formed on the inserting surface and located on an outer side of the keyhole; and the tubular lock assembly has a rubber ring mounted in the sealing annular groove and tightly fit against the inner surface of the covering board segment of the cover.

6. The tubular lock assembly as claimed in claim 1, wherein the first fitting segment of the cover has a cavity formed on the outer surface and concaved toward the inner surface;

a fitting block formed in the cavity;

the second fitting segment of the disassembling unit has a cylinder corresponding in shape and size with an inner peripheral surface of the cavity of the first fitting segment;

a fitting cavity formed on an end surface of the cylinder and corresponding in shape and size with the fitting block.

7. The tubular lock assembly as claimed in claim 1, wherein the tubular lock has a sealing annular groove formed on the inserting surface and located on an outer side of the keyhole; and the tubular lock assembly has a rubber ring mounted in the sealing annular groove and tightly fit against the inner surface of the covering board segment of the cover.

* * * * *